United States Patent [19]

Salsky et al.

[11] 4,391,088

[45] Jul. 5, 1983

[54] STRING FOR SPORTS RACKETS

[75] Inventors: Jerome Salsky, Emerson, N.J.; Patrick K. Janis, Oak Park, Ill.; Kenneth E. Branen, Nashua, N.H.

[73] Assignee: United States Tennis Gut Association, Inc., Emerson, N.J.

[21] Appl. No.: 339,082

[22] Filed: Jan. 13, 1982

[51] Int. Cl.[3] ..... D02G 3/04; D02G 3/10; D02G 3/38; D02G 3/40

[52] U.S. Cl. ..... 57/234; 57/232; 57/241; 57/242; 57/251; 273/73 R; 273/DIG. 23; 428/395; 428/377

[58] Field of Search ..... 57/210, 232, 234, 241, 57/242, 243, 244, 250, 251, 258; 273/73 R, DIG. 23; 428/395, 377

[56] References Cited

U.S. PATENT DOCUMENTS

| | | | |
|---|---|---|---|
| 1,642,720 | 4/1927 | Dritz | 273/73 |
| 1,970,376 | 8/1934 | Hamburger | 117/53 |
| 2,307,470 | 1/1943 | Salathe, Jr. | 117/141 |
| 2,735,258 | 2/1956 | Crandall | 57/234 |
| 2,861,417 | 11/1958 | Crandall | 57/310 X |
| 3,050,431 | 8/1962 | Crandall | 57/7 |
| 3,298,856 | 1/1967 | Harding | 428/473 |
| 3,652,510 | 3/1972 | Blomberg . | |
| 3,673,143 | 6/1972 | Bair et al. . | |
| 3,699,085 | 10/1972 | Johnson . | |
| 3,738,096 | 6/1973 | Crandall | 57/242 |
| 3,920,658 | 11/1975 | Benson | 273/73 R X |
| 4,016,714 | 4/1977 | Crandall et al. | 57/234 |
| 4,084,399 | 4/1978 | Kanemaru | 57/251 X |
| 4,183,200 | 1/1980 | Bajaj | 57/234 |
| 4,202,164 | 5/1980 | Simpson et al. | 57/232 |
| 4,275,117 | 6/1981 | Crandall | 57/251 X |
| 4,297,835 | 11/1981 | Shimizu | 57/234 X |

FOREIGN PATENT DOCUMENTS

| | | | |
|---|---|---|---|
| 2804446 | 8/1979 | Fed. Rep. of Germany | 57/234 |

*Primary Examiner*—Donald Watkins
*Attorney, Agent, or Firm*—Charlotte M. Kraebel

[57] ABSTRACT

A string for sports rackets consists of a gut core covered with filamentary aramid and impregnated with at least one coating of water-resistant, vapor-impermeable, flexible smooth adhesive polymeric resin, which adheres the filamentary aramid to the gut core.

15 Claims, 2 Drawing Figures

STRING FOR SPORTS RACKETS

DESCRIPTION

TECHNICAL FIELD

This invention relates to strings for rackets, particularly to strings capable of being stretched in the frame of a racket appropriate for sports such as tennis, badminton, squash, racket ball or the like.

PRIOR ART

It has been proposed by Salathe, Jr. (U.S. Pat. No. 2,307,470) to apply a layer of a wear-resisting nylon coating to racket strings made of animal guts or other animal fibrous material, such as sinews.

Dritz has proposed, in U.S. Pat. No. 1,624,720, to wind wire helically around a stranded gut body, so as to embed the convolutions of the wire into the outer surface of the gut body and provide a string for rackets, which has the resiliency of natural gut, but has an outer wear surface provided by the wire.

Benson has proposed, in U.S. Pat. No. 3,920,658, coating a tennis string of gut, nylon or polyester with a skidproof material to make the strings more effective than conventional strings, which have a smooth surface, in imparting spin to a ball.

Although tennis racket strings made from animal gut have greater sensitivity and better "feel" to the player than strings made from plastics, natural gut tends to deteriorate rather rapidly. String made from animal gut is susceptible to the effects of moisture. Moist strings tend to stretch and then to contract upon drying, which leads to loss of resiliency and early breakage.

Breakage of animal gut fibers means that rackets strung therewith must be restrung prematurely.

In many cases, the short useful life of natural gut strings is economically unacceptable, so that equipment manufacturers have proposed a variety of longer-lived tennis string constructions using plastic or elastomeric components. Among structures disclosed in the U.S. Patent literature are those of:

U.S. Pat. No. 1,970,376, Hamburger
U.S. Pat. No. 2,735,258, Crandall
U.S. Pat. No. 2,861,417, Crandall
U.S. Pat. No. 3,050,431, Crandall
U.S. Pat. No. 3,738,096, Crandall
U.S. Pat. No. 4,016,714, Crandall et al.
U.S. Pat. No. 4,084,399, Kanemaru
U.S. Pat. No. 4,183,200, Bajaj Notwithstanding the longer life of tennis strings made from synthetic resins, many devoted tennis players prefer the playing characteristics imparted to a racket by natural gut strings and will tolerate the expense and inconvenience associated with periodic replacement or restringing of rackets having natural gut strings.

It will be understood that gut of small diameter has much better playing qualities than gut of larger diameter, but markedly shorter life. Therefore, attempts to improve the life span of string for rackets using gut of increased diameter has met with mixed acceptance, owing to loss of resiliency and "feel" as the diameter of the gut is increased.

Until the introduction of so-called oversize rackets, natural gut strings could be strung in conventional rackets at a tension of 48–65 pounds, in which range the natural gut did not break during stringing. However, in order to make oversize rackets with acceptable playing qualities, it has been found that the rackets must be strung at about 70–85 pounds tension. As a result of the high tension used while stringing oversize rackets, natural gut strings broke both during stringing and after an unduly short useful life. This problem is particularly severe in the case of attempted use of thin gut string for oversize rackets.

It is an object of this invention to provide a gut-derived construction, adapted for stringing, under high tensions, in rackets for tennis or other racket sports and to provide strings which retain the excellent play characteristics of gut strings and which do not undergo undue breakage during stringing or use.

DISCLOSURE OF INVENTION

This invention relates to a string for sports rackets consisting of a gut core covered with filamentary aramid and impregnated with at least one coating of water-resistant, vapor-impermeable, wear-resistant, flexible smooth adhesive polymeric resin to adhere the filamentary aramid to the gut core.

Gut cores used in the practice of this invention are made by processing animal intestines, obtained from slaughter houses, in a manner well known in the art. Owing to generally ready availability of animal intestines from meat processors, beef or sheep gut would be preferred for use in the practice of this invention. The processed gut normally will have a diameter of 0.040–0.050 inch.

In accepted procedures for processing animal gut, the dried gut is polished by treatment with a slightly abrasive material to produce a smooth, essentially cylindrical product, which is free of minute irregularities, knobs and undulations present in gut at the end of the drying step.

Although polished gut cores can be used as a core for the strings of this invention, it has been found that unpolished gut is preferred, not only for economic reasons, but also because the increased surface area of the gut is thought to permit better engagement between the aramid filaments and the gut. Unpolished gut is also known as rough gut.

Aramid polymer is used in the form of filaments, which are wound helically or braided around the gut core. Aramid filaments are available under the name of KEVLAR (duPont trademark). Aramid resins are also known generically as aromatic polycarbonamides, as described in U.S. Pat. Nos. 3,652,510; 3,673,143 and 3,699,085. Fibers made from this family of polymers have extremely high strength, high modulus, good wear properties and low elongation, as disclosed by Simpson (U.S. Pat. No. 4,202,164).

The aramid filaments can be wound helically around the gut core or braided therearound. It is preferred that the aramid filaments be braided over the gut core, using conventional braiding procedures employing a plurality of bobbins. The breaking strength of the racket strings is affected by the angle at which the bobbins are disposed with respect to the gut core. To achieve maximum breaking strength in the braided core structure, it is preferred to maintain the braiding bobbins at an angle of 40°–50° with respect to the core during braiding. Most preferably, the bobbins will be at an angle of 43°–47°.

The water-resistant, vapor-impermeable, flexible, smooth adhesive polymeric resin, with which the wound or braided gut core substructure is impregnated may be selected from varnishes or sealers, whether based on natural resins, alkyd resins or polyurethanes. It is preferred to employ an air-curing polyurethane varnish, applied by passing the aramid braided or wound gut core through a solution of the varnish in an organic solvent.

Air-curing polyurethane systems are based on reaction products from diisocyanates, polyols and drying oils. The resins cure by reaction of the drying oil with oxygen in the air. Materials adapted for use in the practice of this invention are also known as urethane oils and are prepared by making a partial ester by reaction between a free fatty acid and a polyol or by alcoholysis of an oil with a polyol. The resulting intermediate partial ester is reacted with toluene diisocyanate or another selected diisocyanate to give an oil-modified polyurethane.

Another polyurethane system which can be used is the type of top coating disclosed by Harding (U.S. Pat. No. 3,298,856). Polyurethane varnishes are preferred to alkyd varnishes because of their shorter drying time.

The polymeric resin is preferably applied from a solution in an organic solvent, of which methyl ethyl ketone, ethyl acetone, chlorobenzene and aromatic alcohols are exemplary. A preferred system for impregnating the gut-aramid filament substructure is a solution of air-drying polyurethane varnish, containing 20–25% of solids, in a mixed aromatic alcohol solvent.

The polyurethane varnish is conveniently applied by running the gut-aramid substructure through the solution of varnish under ambient conditions. Because the polymeric resin is dissolved in the solvent, the solution will migrate through the braid or helical winding of aramid filaments to the gut core and provide the requisite adhesion between the layers. It has been found that the adhesive coating cures to a dry, non-tacky touch within about two hours at room temperature.

It is preferred, according to the practice of this invention, to employ a plurality of layers of adhesive polymeric coating, most preferably two or three coats. The second and subsequent coats of adhesive polymeric coating are applied in the same fashion as the first, allowing 1–4 hours of drying at ambient temperature between successive coats.

Use of a plurality of coats of polymeric resins permits encapsulation of the aramid filaments braided or wound around the gut core, so as to exclude moisture from the aramid and substantially decrease the likelihood of moisture-induced degradation of the aramid winding or braid and provide abrasion resistance.

Strings for sports rackets, made as above, have a breaking strength (tensile strength) of at least 100 pounds, generally as high as 140 pounds or higher. Therefore, these strings are particularly adapted for stringing oversize tennis rackets at up to 85 pounds of tension during stringing. The strings of this invention can also be strung at conventional tensions in standard rackets, to provide longer-lived strings than gut-based strings presently available. String thus employed has an acceptable life cycle and has the resiliency or "feel" of natural gut.

Because aramid fibers are damaged by exposure to ultraviolet light, it may be desirable to prolong the life of the strings by incorporating into one of more of the polymeric resin coatings an ultraviolet absorber. For a dramatic effect, the ultraviolet absorber can be carbon black; the resulting strings will be black or gray. If a lighter-colored string will be more esthetically acceptable to the ultimate user than a black string, a relatively colorless organic ultraviolet absorber, compatible with the polymeric resin and the solvent system, can be used. Typical of organic ultraviolet absorbers which can be used are coumarin ethers, esters of p-aminobenzoic acid or substituted p-aminobenzoic acids, such as glyceryl p-aminobenzoate; esters of p-methoxycinnamic acid, such as 2-ethoxyethyl p-methoxycinnamate; benzophenone derivatives, such as 2-hydroxy-4-methoxybenzophenone and derivatives of bis-alpha-cyano-beta, beta-diphenylacrylic acid.

Because the strings made by the teachings of this invention are flexible, delamination or abrasion may become a problem during stringing of sports rackets, particularly at the eight so-called double holes of a tennis racket. To facilitate the stringing procedure, the ends of the string can be cut at an angle of 15°–20° and the cut end coated with a stiffening resin, such as an acrylic or epoxy resin. The resulting end structure can be strung more readily than the flexible unmodified string.

DESCRIPTION OF MOST PREFERRED EMBODIMENT

In a most preferred case, the string is constructed of unpolished beef or sheep gut braided with aramid filaments over the gut core, wherein the filamentary aramid is braided over the gut core by maintaining the braiding bobbins at an angle of 40°–50° with respect to the core, the adhesive polymeric resin is an air-curing polyurethane and the string has a tensile strength of 100–140 pounds.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following Examples, temperatures are set forth uncorrected in degrees Celsius. Unless othewise indicated, all parts and percentages are by weight.

EXAMPLE 1

Figure 1:
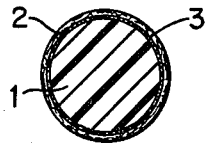
In FIG. 1 is shown an enlarged cross-sectional view view of the tennis string of the invention.
Figure 2:
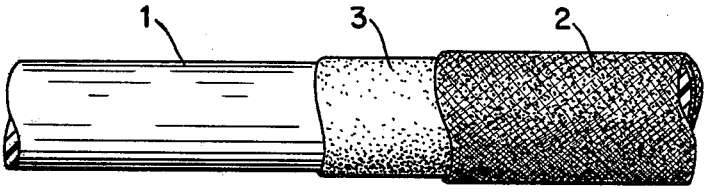
In FIG. 2 is shown an enlarged side view of a tennis string in accordance with the invention.

Polished beef gut (1 in FIG. 2) is covered by braiding with aramid filaments (2 in FIGS. 1 and 2). The covered gut is passed through a solution of air-drying polyurethane varnish (21% solids in an aromatic alcohol mixture) without stretching the gut. The resulting coated gut is allowed to dry in air for 2–3 hours before application of a second coat of the same polyurethane resin. After 2–3 hours' drying, a third coating of the same polyurethane resin is applied and allowed to dry. The final polyurethane resin coating is a unitary coating (3 in FIGS. 1 and 2), extending from the surface of the gut through and over the braided aramid coating.

EXAMPLE 2

Unpolished beef gut (0.040–0.050 inch in diameter) was covered by braiding with aramid (KEVLAR) filaments, using six ends of aramid filaments, each of 400 denier. The bobbins holding the aramid fibers were kept at an angle of 44°–46° with respect to the gut during braiding.

The braid-covered gut was passed through a solution of air-drying polyurethane varnish (22% solids) in an aromatic alcohol mixture. The polyurethane varnish was applied under ambient conditions, without application of stretching forces to the braid-covered gut. The polyurethane coating was allowed to dry and cure under ambient conditions foe 2 hours. Second and third coats of polyurethane were applied in the same way.

The string obtained had a tensile strength of 100–140 pounds and could be used for stringing oversized tennis rackets, which had the same playing characteristics as rackets strung with gut not strengthened with aramid filaments.

EXAMPLE 3

Unpolished sheep gut is covered with aramid filaments, which are wound helically over the gut core. The wound core is coated with two coats of air-drying polyurethane varnish, which is applied in a vacuum chamber from a 20–25% solution in aromatic alcohols. Each coating is allowed to dry in air for 1.5–2.5 hours.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

We claim:

1. A string for sports rackets consisting of a gut core covered with filamentary aramid and impregnated with at least one coating of water-resistant, vapor-impermeable, wear-resistant, flexible smooth adhesive polymeric resin.

2. The string of claim 1, wherein the gut is unpolished sheep or beef gut.

3. The string of claim 1, wherein the filamentary aramid is helically wound around the gut core.

4. The string of claim 1, wherein the filamentary aramid is braided over the gut core.

5. The string of claim 1, wherein the adhesive resin is an air-curing polyurethane resin and two or three coatings of said resin are used.

6. The string of claim 1, wherein the string has a tensile strength of 100–140 pounds.

7. The string of claim 1, wherein the adhesive resin is air-curing polyurethane, applied from a solution of polyurethane in mixed aromatic alcohol solvent containing 20–25% of polyurethane.

8. The string of claim 5, wherein the air-curing polyurethane contains carbon black or an organic ultraviolet absorber.

9. The string of claim 4, wherein the filamentary aramid is braided over the gut core by maintaining the braiding bobbins at an angle of 40°–50° with respect to the core.

10. The string of claim 1, wherein the gut is unpolished sheep or beef gut braided with filamentary aramid over the gut core, the filamentary aramid is braided over the gut core by maintaining the braiding bobbins at an angle of 40°–50° with respect to the core, the adhesive polymeric resin is an air-curing polyurethane and the string has a tensile strength of 100–140 pounds.

11. The string of claim 1, wherein the gut is unpolished sheep or beef gut braided with filamentary aramid over the gut core, the filamentary aramid is braided over the gut core by maintaining the braiding bobbins at an angle of 40°–50° with respect to the core, the adhesive polymeric resin is an air-curing polyurethane containing carbon black or an organic ultraviolet absorber, and the string has a tensile strength of 100–140 pounds.

12. The string of claim 1, wherein the end thereof is severed diagonally and the thus-severed end is overcoated with an acrylic or epoxy resin.

13. The string of claim 10, wherein the end thereof is severed diagonally and the thus-severed end is overcoated with an acrylic or epoxy resin.

14. A sports racket strung with the string of claim 1.

15. A sports racket strung with the string of claim 10.

* * * * *